United States Patent [19]

Chu

[11] Patent Number: 5,000,878

[45] Date of Patent: Mar. 19, 1991

[54] PHOTOCHROMIC ARTICLES WITH THERMALLY STABLE PHOTOCOLORABILITY

[75] Inventor: Nori Y. C. Chu, Shrewsbury, Mass.

[73] Assignee: American Optical Corporation, Southbridge, Mass.

[21] Appl. No.: 314,955

[22] Filed: Feb. 24, 1989

[51] Int. Cl.[5] ..... F21V 9/04; F21V 9/06

[52] U.S. Cl. ..... 252/587; 544/71; 350/354

[58] Field of Search ..... 544/70, 71; 252/582, 252/586, 589, 600, 587; 350/354

[56] References Cited

U.S. PATENT DOCUMENTS 4,215,010 7/1980 Hovey et al. ..... 252/300
4,720,547 1/1988 Kwak et al. ..... 544/71
4,784,474 11/1988 Yamamoto et al. ..... 350/354

FOREIGN PATENT DOCUMENTS 61-291678 12/1986 Japan .
2117390 10/1983 United Kingdom .

*Primary Examiner*—John S. Maples
*Assistant Examiner*—Richard Treanor
*Attorney, Agent, or Firm*—Fishman, Dionne & Cantor

[57] ABSTRACT

Spirooxazine compounds are incorporated into a plastic host comprised of copolymers of poly(vinyl alcohol) and poly(vinyl acetate). This combination results in a photochromic composite which exhibits significantly improved temperature stability relative to the prior art.

7 Claims, 1 Drawing Sheet

PHOTOCHROMIC ARTICLES WITH THERMALLY STABLE PHOTOCOLORABILITY

BACKGROUND OF THE INVENTION

The present invention relates to a temperature stable photochromic composite. More particularly, the present invention relates to a photochromic composite material wherein the active photochromic component comprises spirooxazines and the polymeric host comprises copolymers of poly(vinyl alcohol) and poly(vinyl acetate).

Compounds which undergo reversible photo-induced color changes are termed photochromic compounds. When subjected to ultraviolet or visible light irradiation, these photochromic compounds change their light transmission properties and hence undergo color changes. Photochromic compounds subsequently revert to their original color state when they are subjected to a different wavelength of radiation or when the initial light source is removed.

The photochromism of spirooxazine compounds is well known and disclosed, for example, in U.S. Pat. Nos. 3,562,172 and 3,578,602. These compounds are spirooxazine derivatives with substitutions in the indoline portion of the molecule. U.S. Pat. Nos. 4,215,010 and 4,342,668 disclose spirooxazine derivative compounds with substitution in the naphthalene part of the molecule in addition to substitution in the indoline part of the molecule. The spirooxazine derivative compounds in the latter two patents exhibit an enhanced photocolorability when compared to the spirooxazine derivative compounds disclosed in U.S. Pat. Nos. 3,562,172 and 3,578,602. Other spirooxazine compounds having different ring systems have been reported. For example, European Patent Application EP No. 245,202, U.S. Pat. No. 4,637,698, Japan Kokai Tokkyo Koho JP No. 62 72,778 and JP No. 62-164,685 disclose spirooxazine compounds in which the naphthalene part of the molecule is replaced by benzene, quinoline, anthracene and phenanthrene, respectively.

Commercial applications for photochromic compositions of the type hereinabove described include sunglasses, ophthalmic lenses, ski goggles, window coatings and the like. In these applications, the Photochromic compositions are incorporated into a plastic host material such as cellulose acetate butyrate, poly(vinyl butyral) and the like.

The composition of the plastic host influences the photocolorability of the spirooxazine compounds. Unfortunately, it is well known that regardless of how the compositions of the plastic hosts are varied, the photocolorability of plastic articles made from most common commercially available plastics show a strong temperature dependence. Namely, photocolorability of the plastic article decreases as the temperature increases. At temperatures greater then 60°-70° F., the photocolorability is substantially decreased. This temperature dependence is highly undesirable and acts to limit the successful utilization of these photochromic compounds in many applications.

SUMMARY OF THE INVENTION

The above-discussed problems and other disadvantages of the prior art are overcome or alleviated by the photochromic composite of the present invention. In accordance with the present invention, spirooxazine compounds are incorporated into a plastic host comprised of copolymers of poly(vinyl alcohol) and poly(vinyl acetate). This combination results in a photochromic composite which exhibits significantly improved temperature stability relative to the prior art.

The photochromic composite of the present invention may be incorporated into photochromic sunglass lenses, ski goggles, ophthalmic lenses, window coatings, and the like. Significantly, the photochromic composite of this invention exhibit stable temperature characteristics at temperatures which exceed 60°-70° F.

The above-discussed and other features and advantages of the present invention will be apparent to and understood by those skilled in the art from the following detailed description and drawings.

DESCRIPTION OF THE PREFERRED EMBODIMENT

Figure 1:
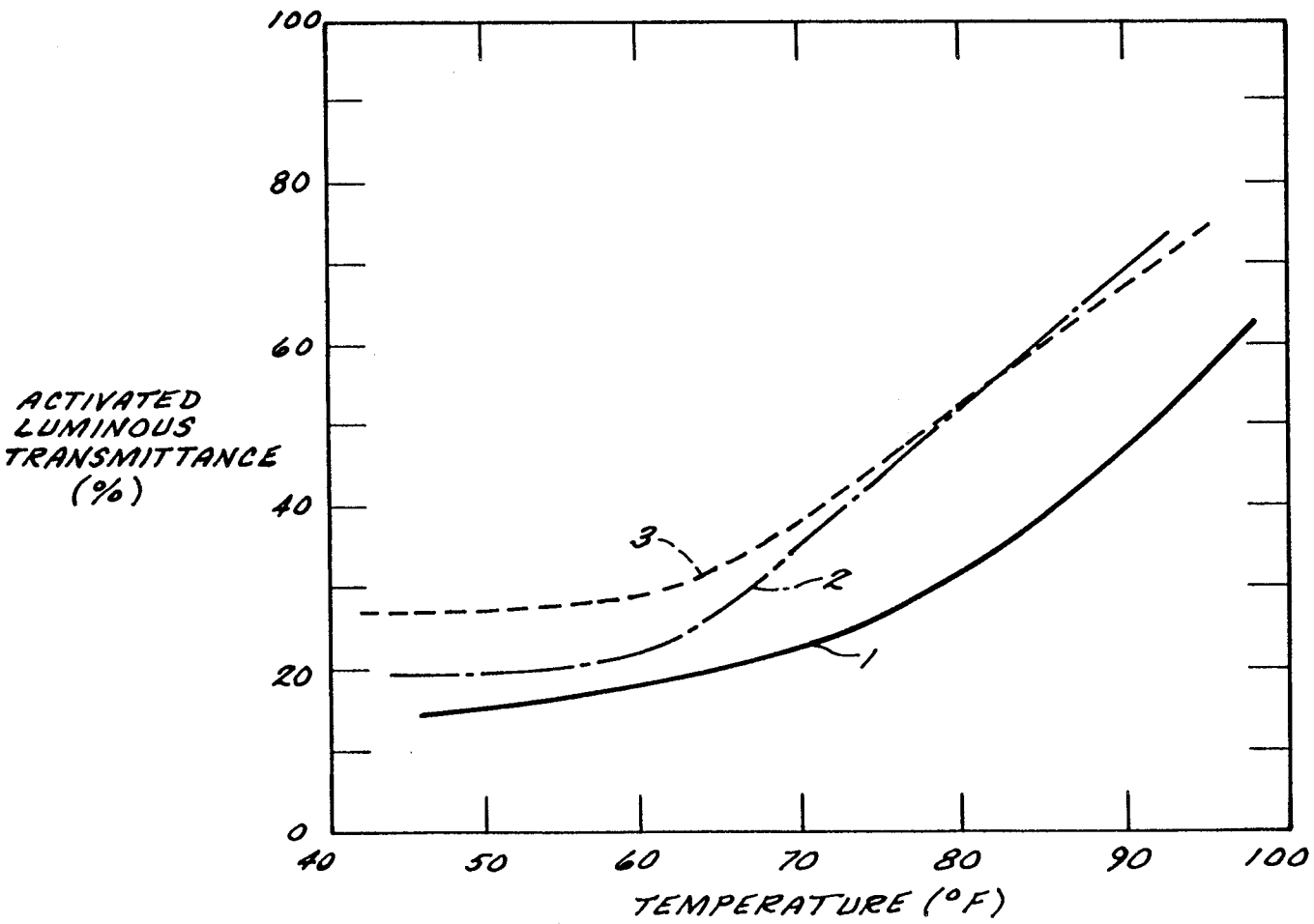
FIGURE 1 is a graph illustrating the temperature dependency of photocolorability in prior art photochromic composites.

The present invention relates to photochromic compositions wherein the active photochromic component comprises spirooxazines which have the following chemical structural formula:

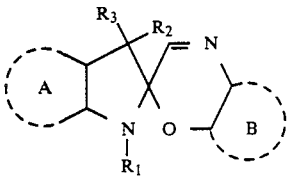

(1)

where $R_1$, $R_2$ and $R_3$, is either a lower alkyl, including aryl substituted aklyl, lower alkoxy, alkoxyalkyl, cycloalky-/or an aryl group; and A and B are substituted or unsubstituted aromatic hydrocarbons or heterocyclic compounds. The photochromic compound of Formula 1 will be referred to hereinafter as spirooxazine compounds.

Referring now to FIG. 1, a graph is shown which depicts the photochromic temperature sensitivity of prior art photochromic compositions which incorporate spirooxazine components and common commercially available plastics. These plastics are cellulose acetate butyrate (identified at 1), polyurethane (identified at 2), and epoxy (identified at 3).

As is clear from FIG. 1, the photocolorability of plastic articles made of spirooxazine compounds and common commercially available plastics show a strong temperature dependence. Below 60°-70° F., the photocolorability of the plastic articles is generally stable. However, above 60°-70° F., the photocolorability of the plastic articles markedly decrease Unfortunately, these plastic articles are often used in applications above 60°-70° F., which thus significantly reduces the photocolorability of the article.

In accordance with the present invention, it has now been discovered that photochromic articles made from known spirooxazine compounds and copolymers of poly(vinyl alcohol) and poly(vinyl acetate) exhibit markedly improved temperature stability/photocolorability characteristics relative to the prior art. The photocolorability of articles made from the photochromic compositions of this invention are not as temperature sensitive as are the prior art plastic articles. As a result, articles manufactured with the compounds of the present invention can be used effectively in temperatures above 60°–70° F. without loss of photocolorability.

This discovery [e.g., the use of copolymers of poly(vinyl alcohol) and poly(vinyl acetate) as the plastic host composition for photochromic materials employing spirooxazine compounds] is both surprising and expected in view of the long held belief that commercially available plastic hosts will limit temperature stability.

Examples of preferred spirooxazine compounds well suited for use in the present invention include at least the following:

spiro[indoline-2,3'-[3H]-napth[2,1-b][1,4] oxazine having the structural formula:

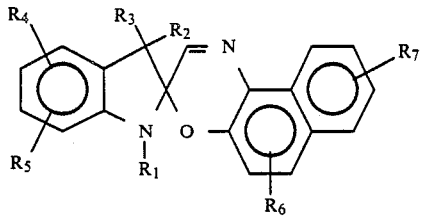

(2)

spiro[indoline-2,2'-[2H]-naphth[1,2-b][1,4] oxazine having the structural formula:

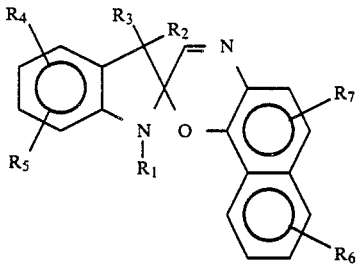

(3)

spiro[indoline-anthr[1,4] oxazine having the structural formula:

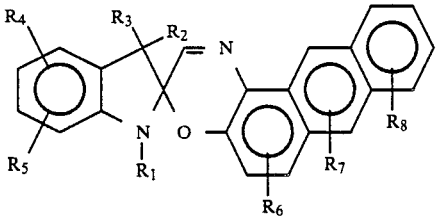

(4)

spiro[indoline-2,2'-[2H]-phenanthro[9,10-b][1,4] oxazine having the structural formula:

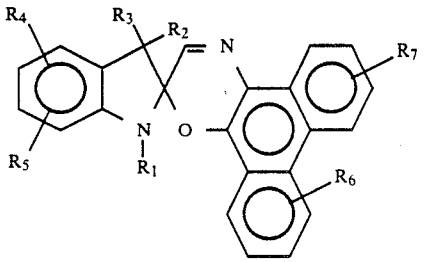

(5)

spiro[piperidine-2,3'-[3H]napth[2,1-b][1,4] oxazine having the structural formula:

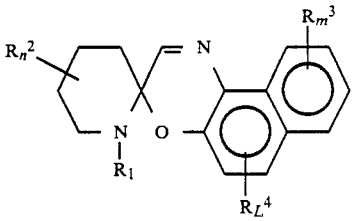

(6)

spiro[indoline-2,3'-[3H]pyrido[3,2-f][1,4] benzoxazine having the structural formula:

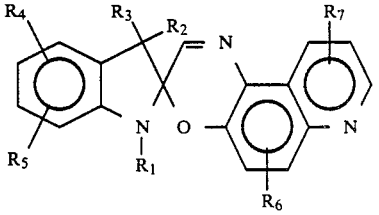

(7)

The improved temperature stability of the present invention will be understood by one of ordinary skill in the art from the following non-limiting examples:

EXAMPLE 1

Forty (40) grams of Gelvatol 40/20, a copolymer of poly(vinyl alcohol) and poly(vinyl acetone) (Monsanto) and 0.8 grams of 1,3,3,4,5- and 1,3,3,5,6-pentamethyl-9'-methoxy spirooxazine isomer mixture (A) are dissolved in a solution composed of 10 grams glycerol, 60 grams water, and 150 grams acetone. The resultant solution is coated on to a 2"×2" glass plate and baked in an oven at 160° F. for one hour. The temperature stability of the photocolorability of the coated glass plate is shown in Table 1.

TABLE 1

Temperature stability of the composite of Example 1

| | | | | | |
|---|---|---|---|---|---|
| Temperature | (°F.) | 41 | 69 | 80 | 95 |
| Luminous Transmittance | (%) | 28 | 28 | 31 | 33 |

EXAMPLE 2

Two (2) grams of poly(vinyl acetate-co-vinyl alcohol) obtained from Polysciences, Inc., and 0.2 gram spirooxazine isomer mixture (A) are dissolved in 7.0 grams of methyl cellosolve acetate. The solution is coated onto a CR-39 plate and dried in an oven at 160° F. for 30 minutes. The temperature stability of the photocolorability of the coated glass plate is shown in Table 2.

TABLE 2

| Temperature stability of the composite of Example 2 | | | | |
|---|---|---|---|---|
| Temperature | (°F.) | 59 | 73 | 95 |
| Luminous Transmittance | (%) | 48 | 46 | 53 |

As is clear from a review of Examples 1 and 2, the photochromic compounds of the present invention exhibit substantially stable photocolorability at temperatures in the 60°-70° F. range and beyond (e.g., 95° F.).

In Formulas 2-7, $R_4$, $R_5$, $R_6$, $R_7$, $R_n^2$, $R_m^3$, $R_l^4$, $R_m^4$, $R_n^5$, $R_l^6$, $R_k^7$ each represents independently a hydrogen, halogen, alkyl, cycloalkyl, alkoxy, carboalkyl, cyano, amino phenyl, or trifluoromethyl group. K, l, m, and n are integers.

While preferred embodiments have been shown and described, various modifications and substitutions may be made thereto without departing from the spirit and scope of the invention. Accordingly, it is to be understood that the present invention has been described by way of illustration and not limitation

What is claimed is:

1. A photochromic article, comprising:

a plastic host, said plastic host consisting essentially of a copolymer of poly (vinyl alcohol) and poly (vinyl acetate); and a photochromic compound incorporated into the plastic host, said photochromic compound having a structural formula according to:

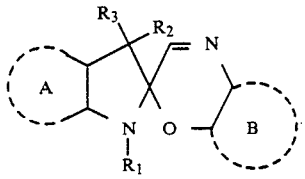

where:

$R_1$, $R_2$ and $R_3$ are each independently lower alkyl cycloalkyl, lower alkoxy or aryl;

A and B are each independently unsubstituted aromatic, unsubstituted heterocyclic, substituted aromatic or substituted heterocyclic;

said photochromic article exhibiting improved temperature stability with regard to photocolorability.

2. A photochromic article, comprising:

a plastic host, said plastic host consisting essentially of a copolymer of poly(vinyl alcohol) and poly(vinyl acetate); and a photochromic spirooxazine compound incorporated into the plastic host, said photochromic spirooxazine compound having a structural formula according to:

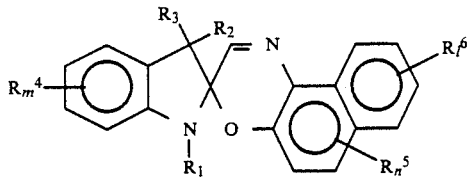

wherein:

$R^4$, $R^5$ and $R^6$ are each independently hydride, halo, alkyl, cycloalkyl, alkoxyl, cyano, amino, phenyl or trifluoromethyl and l, m and n are integers.

3. A composite according to claim 1 wherein said photochromic compound comprises a spiro[indoline-2,2'-[2H]-naphth[1,2-b][1,4] oxazine having the structural formula:

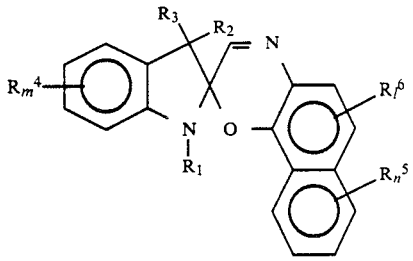

where $R_m^4$, $R_n^5$, and $R_l^6$ each represent independently a hydrogen, halogen, alkyl, cycloalkyl, alkoxy, cyano, amino phenyl, or trifluoromethyl group and m, n and l are integers.

4. A composite according to claim 1 wherein said photochromic compound comprises a spiro[indoline-anthr[1,4] oxazine having the structural formula:

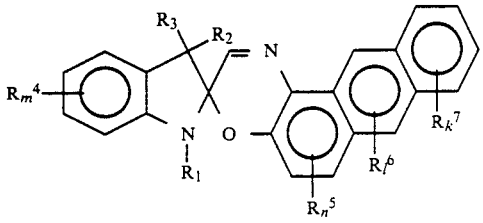

where $R_m^5$, $R_n^6$ and $R_k^7$ each represent independently a hydrogen, halogen, alkyl, cycloalkyl, alkoxy, cyano, amino, phenyl, or trifluoromethyl group and m, n and l are integers.

5. A composite according to claim 1 wherein said photochromic compound comprises a spiro[indoline-2,2'-[2H] phenathro[9,10-b][1,4] oxazine having the structural formula:

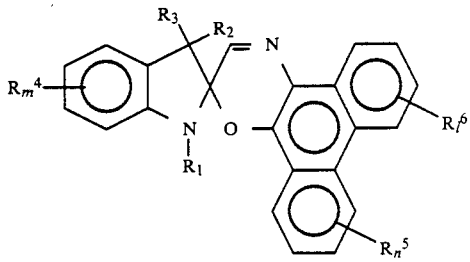

where $R_m^4$, $R_n^5$, and $R_l^6$ reach represent independently a hydrogen, halogen, alkyl, cycloalkyl, alkoxy, cyano, amino, phenyl, or trifluoromethyl group and m, n and l are integers.

6. A composite according to claim 1 wherein said photochromic compound comprises a spiro[piperidine-2,3'-[3H]naphth[2,1-b][1,4] oxazine having the structural formula:

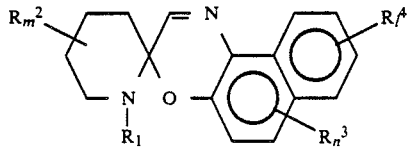

where $R_l^4$ represents independently a hydrogen, halogen, alkyl, cycloalkyl, alkoxy, carboalkyl, cyano, amino, phenyl or trifluoromethyl group and m, n and l are integers.

7. A composite according to claim 1 wherein said photochromic compound comprises a spiro[indoline-2,3'-[3H]pyrido[3,2-f][1,4] benzoxazine having the structural formula:

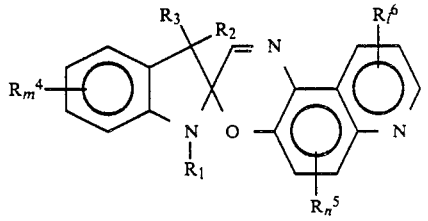

where $R_m^4$, $R_n^5$, $R_l^6$ each represent independently a hydrogen, halogen, alkyl, cycloalkyl, alkoxy, cyano, amino, phenyl, or trifluoromethyl group and m, n and l are integers.

* * * * *

UNITED STATES PATENT AND TRADEMARK OFFICE

CERTIFICATE OF CORRECTION

PATENT NO. : 5,000,878

DATED : March 19, 1991

INVENTOR(S) : Nori Y. C. Chu

It is certified that error appears in the above-identified patent and that said Letters Patent is hereby corrected as shown below:

Col. 1 line 45 and 46, delete "Photochromic" and insert —photochromic—.
Col. 2 line 39 delete "aklyl" and insert —alkyl—.
Col. 2 line 58 insert —.— after "decrease—.
Col. 3 line 22 delete"[2,1-b]" and insert —[2,1-b]—.
Col. 3 line 67 delete "[9,10-b]" and insert —9,10-b]—.
Col. 4 line 26 delete "[3,2-f]" and insert —[3,2-f]—.
Col. 4 lines 44, 45: Delete "Gelvatol 40/20, a copolymer of poly(vinyl alcohol) and poly(vinyl acetone) (Monsanto)" and insert therefore –a copolymer of poly(vinyl alcohol) and poly(vinyl acetate) (Gelvatol 40/20 (Monsanto))–.

Col. 5 line 24 insert —.— after "limitation".
Col. 5 line 30 insert —spirooxazine— after "photochromatic".
Col. 5 line 31 insert —spirooxazine— after "photochromatic".
Col. 6 line 40 Delete " $R_m^5$, $R_n^6$, and $R_k^7$ " and insert therefor – $R_m^4$, $R_n^5$, $R_l^6$, and $R_k^7$ –.

Col. 6 line 46 delete "[9,10-b]" and insert —[9,10-b]—.

UNITED STATES PATENT AND TRADEMARK OFFICE

CERTIFICATE OF CORRECTION

PATENT NO. : 5,000,878

DATED : March 19, 1991

INVENTOR(S) : Nori Y.C. Chu

It is certified that error appears in the above-identified patent and that said Letters Patent is hereby corrected as shown below:

Col. 6 line 61 delete "reach" and insert --each--.
Col. 7 line 12 delete "carboalkyl"
Col. 8 line 1 delete "[3H]" and insert --[3H]--.
Col. 8 line 1 delete "[3,2-f]" and insert --[3,2-f]--.

Signed and Sealed this

Twenty-third Day of November, 1993

Bruce Lehman

*Attest:*

BRUCE LEHMAN

*Attesting Officer*

*Commissioner of Patents and Trademarks*